US011158278B2

(12) United States Patent
Xiao

(10) Patent No.: US 11,158,278 B2
(45) Date of Patent: Oct. 26, 2021

(54) DISPLAY COMPONENT COMPENSATION METHOD AND DEVICE FOR FREQUENCY OF SPREAD-SPECTRUM COMPONENT AND CHARGING TIME

(71) Applicant: TCL CHINA STAR OPTOELECTRONICS TECHNOLOGY CO., LTD., Guangdong (CN)

(72) Inventor: Guangxing Xiao, Shenzhen (CN)

(73) Assignee: TCL CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 16/761,818

(22) PCT Filed: Apr. 10, 2020

(86) PCT No.: PCT/CN2020/084164

§ 371 (c)(1),
(2) Date: May 6, 2020

(65) Prior Publication Data

US 2021/0304697 A1 Sep. 30, 2021

(51) Int. Cl.
*G09G 3/36* (2006.01)

(52) U.S. Cl.
CPC ... *G09G 3/3688* (2013.01); *G09G 2310/0251* (2013.01); *G09G 2310/08* (2013.01);
(Continued)

(58) Field of Classification Search
CPC ..... G09G 2310/08; G09G 2310/0289; G09G 3/3696; G09G 2310/0232; G09G 2340/02;
(Continued)

(56) References Cited

U.S. PATENT DOCUMENTS 9,196,218 B2 11/2015 Kim et al.
2003/0052852 A1 3/2003 Oohira
(Continued)

FOREIGN PATENT DOCUMENTS

CN 1720493 A 1/2006
CN 103578396 A 2/2014
CN 107087132 A 8/2017

*Primary Examiner* — Ram A Mistry
(74) *Attorney, Agent, or Firm* — The Roy Gross Law Firm, LLC; Roy Gross

(57) ABSTRACT

The disclosure provides a display component compensation method and a display component compensation device. The display component compensation method includes: obtaining a frequency value of a spread-spectrum component at time $T_n$; obtaining a first charge time $T_{n1}$ of the display component at the time $T_n$; obtaining a second charge time $T_{n2}$ of the display component at the time $T_n$; and obtaining a second falling edge time of a first clock signal of the display component at the time $T_n$ according to a difference between the first charging time $T_{n1}$ and the second charging time $T_{n2}$ of the display component at the lime $T_n$.

14 Claims, 6 Drawing Sheets

(52) U.S. Cl.
CPC . *G09G 2320/0233* (2013.01); *G09G 2330/06* (2013.01); *G09G 2370/16* (2013.01)

(58) Field of Classification Search
CPC ..... G09G 2370/00; G09G 3/36; G05F 1/462; G06F 7/5443; G06Q 10/00; G06Q 10/047; H03M 1/12; H04L 9/00; H04L 9/06; H04L 9/0618; H04L 9/0625; H04L 9/08; H04L 9/0861; H04L 9/088; H04L 9/14; H04N 7/167
See application file for complete search history.

(56) References Cited

U.S. PATENT DOCUMENTS

2005/0057551 A1* 3/2005 Gong ..... H04N 5/0736 345/211
2006/0025094 A1 2/2006 Ozawa et al.
2009/0040160 A1* 2/2009 Jiang ..... G09G 3/20 345/94
2011/0273433 A1* 11/2011 Ahn ..... H02M 3/158 345/213
2012/0169686 A1* 7/2012 Kim ..... G09G 5/008 345/208
2014/0043305 A1 2/2014 Kim
2014/0043317 A1* 2/2014 Kim ..... G09G 3/3688 345/213

* cited by examiner

DISPLAY COMPONENT COMPENSATION METHOD AND DEVICE FOR FREQUENCY OF SPREAD-SPECTRUM COMPONENT AND CHARGING TIME

FIELD

The present disclosure relates to the field of display, and more particularly, relates to a display component compensation method and a display component compensation device.

BACKGROUND

Spread-spectrum technology is a common wireless communication technology that has been used in driving devices of conventional display panels. The spread-spectrum technology can reduce electromagnetic interference (EMI) due to a pulse peak when a clock generator operates on a motherboard. When an EMI problem does not happen, the spread-spectrum technology is in a non-working state, while when the EMI problem happens, the spread-spectrum technology is in a working state to reduce EMI.

In conventional display panels, even a minor shift of peak may cause a short burst of a clock signal, leading to an overclocked processor being locked. For example, as size and resolution of thin film transistor liquid crystal displays (TFT-LCDs) become increasingly large, processors thereof are easily overclocked, which causes the spread-spectrum technology to activate. However, a frequency of the spread-spectrum technology and a frequency of a clock signal are different, contributing to uneven charging between rows and generating a lot of light and dark intervals.

Therefore, it is necessary to provide a display component compensation method to solve the above technical problem.

SUMMARY

The present disclosure provides a display component compensation method and a display component compensation device to solve a technical problem of uneven charging between rows in conventional display components.

The present disclosure provides a display component compensation method, including following steps:

receiving a first input voltage of a display component at time $T_n$, and obtaining a frequency value of a spread-spectrum component at the time $T_n$ according to the first input voltage of the display component, wherein n is an integer;

obtaining a first charging time $L_{n1}$ of the display component at the time $T_n$ according to the frequency value of the spread-spectrum component at the time $T_n$;

obtaining a first falling edge time of a first data signal of the display component and a second falling edge time of a first clock signal of the display component at the time $T_n$, and obtaining a second charging time $L_{n2}$ of the display component at the time $T_n$ according to the first falling edge time of the first data signal and the second falling edge time of the first clock signal; and obtaining the second falling edge time of the first clock signal of the display component at the time $T_n$ according to a difference between the first charging time $L_{n1}$ of the display component and the second charging time $L_{n2}$ of the display component at the time $T_n$.

In the display component compensation method, in the step of receiving the first input voltage of the display component at the time $T_n$, and obtaining the frequency value of the spread-spectrum component according to the first input voltage of the display component, the display component compensation method includes following steps:

receiving a video source signal of the display component at the time $T_n$, and obtaining the first input voltage according to the video source signal of the display component at the time $T_n$; and reading the frequency value of the spread-spectrum component at the time $T_n$ with a predetermined device according to the first input voltage of the display component at the time $T_n$.

The video source signal is emitted from a processor of the display component, and the first input voltage is an image digital signal voltage.

In the display component compensation method, in the step of obtaining the first falling edge time of the first data signal of the display component and the second falling edge time of the first clock signal of the display component at the time $T_n$, and obtaining the second charging time $L_{n2}$ of the display component at the time $T_n$ according to the first falling edge time of the first data signal and the second falling edge time of the first clock signal, the display component compensation method includes following steps:

obtaining the first falling edge time of the first data signal of the display component at the time $T_n$;

obtaining the second falling edge time of the first clock signal of the display component at the time $T_n$;

obtaining the second charging time $L_{n2}$ of the display component at the time $T_n$ according to a difference between the first falling edge time of the first data signal and the second falling edge time of the first clock signal.

obtaining the first falling edge time of the first data signal of the display component at the time $T_n$;

obtaining a row signal of a plurality of data enable (DE) signals of the display component at the time $T_n$;

obtaining a rising edge time of the display component and a falling edge time corresponding to the rising edge time at the time $T_n$; and obtaining the first falling edge time of the first data signal of the display component at the time $T_n$ according to the row signal of the DE signals, the rising edge time of the display component, and the falling edge time corresponding to the rising edge time at the time $T_n$.

The first data signal is emitted from a source driving device in the display component.

In the display component compensation method, in the step of obtaining the second falling edge time of the first clock signal of the display component at the time $T_n$ according to the difference between the first charging time $L_{n1}$ of the display component and the second charging time $L_{n2}$ of the display component at the time $T_n$, the display component compensation method includes following steps:

obtaining a difference X between the first charging time $L_{n1}$ of the display component and the second charging time $L_{n2}$ of the display component at the time $T_n$, and adding the difference X and the first falling edge time of the first clock signal at the time $T_n$ together, and obtaining the second falling edge time of the first clock signal of the display component at the time $T_n$.

The display component compensation method further includes following steps:

obtaining a first charging time $L_{m1}$ of the display component at time $T_m$, and making the first charging time $L_{m1}$ of the display component at an $m^{th}$ frame equal to the first charging time $L_{n1}$ of the display component at the time $T_n$, wherein m is an integer, but is not equal to n.

The disclosure further includes a display component compensation device, including a spread-spectrum obtaining module, a first charging time obtaining module, a second charging time obtaining module, and a compensation module.

The spread-spectrum obtaining module is configured to receive a first input voltage of a display component at time $T_n$, and is configured to obtain a frequency value of a spread-spectrum component at the time $T_n$ according to the first input voltage of the display component, wherein n is an integer.

The first charging time obtaining module is configured to obtain a first charging time $L_{n1}$ of the display component according to the frequency value of the spread-spectrum component at the time $T_n$.

The second charging time obtaining module is configured to obtain a first falling edge time of a first data signal of the display component and a second falling edge time of a first clock signal of the display component at the time $T_n$, and is configured to obtain a second charging time $L_{n2}$ of the display component at the time $T_n$ according to the first falling edge time of the first data signal and the second falling edge time of the first clock signal.

The compensation module is configured to obtain the second falling edge time of the first clock signal of the display component according to a difference between the first charging time $L_{n1}$ and the second charging time $L_{n2}$ of the display component at the time $T_n$.

In the display component compensation device, the spread-spectrum module includes an input voltage obtaining unit and a spread-spectrum frequency obtaining unit.

The input voltage obtaining unit is configured to receive a video source signal of the display component at the time $T_n$, and is configured to obtain the first input voltage according to the video source signal of the display component at the time $T_n$.

The spread-spectrum frequency obtaining unit is configured to read the frequency value of the spread-spectrum component with a predetermined device according to the first input voltage of the display component at the time $T_n$.

The video source signal is emitted from a processor of the display component, and the first input voltage is an image digital signal voltage.

In the display component compensation device, the second charging time obtaining module includes a first falling edge obtaining unit, a second falling edge obtaining unit, and a second charging time obtaining unit.

The first falling edge obtaining time unit is configured to obtain the first falling e time of the first data signal of the display component at the time $T_n$.

The second falling edge obtaining time unit is configured to obtain the second edge time of the first clock signal of the display component at the time $T_n$.

The second charging time obtaining unit is configured to obtain the second charging time $L_{n2}$ of the display component at the time $T_n$ according to a difference between the first falling edge time of the first data signal and the second falling edge time of the first clock signal.

The first falling edge obtaining unit includes a row signal obtaining sub-unit, a data signal obtaining sub-unit, and a first falling edge obtaining sub-unit.

The row signal obtaining sub-unit is configured to obtain a row signal of a plurality of data enable (DE) signals of the display component at the time $T_n$.

The data signal obtaining sub-unit is configured to obtain a rising edge time of the display component and a falling edge time corresponding to the rising edge time at the time $T_n$.

The first falling edge obtaining sub-unit is configured to obtain the first falling edge time of the first data signal of the display component at the time $T_n$ according to the row signal of the DE signal, the rising edge time of the display component, and the falling edge time corresponding to the rising edge time at the time $T_n$.

The first data signal is emitted from a source driving device in the display component.

In the display component compensation device, the compensation module includes a computing unit and a compensation unit.

The computing unit is configured to obtain a difference X between the first charging time $L_{n1}$ of the display component and the second charging time $L_{n2}$ of the display component at the time $T_n$.

The compensation unit is configured to add the difference X and the first falling edge time of the first clock signal at the time $T_n$ together, and is configured to obtain the second falling edge time of the first clock signal of the display component at the time $T_n$.

The display component compensation device further includes a modification module.

The modification module is configured to obtain a first charging time $L_{m1}$ of the display component at time $T_m$, and make the first charging time $L_{m1}$ of the display component at an $m^{th}$ frame equal to the first charging time $L_{n1}$ of the display component at the time $T_n$, wherein in is n is an integer, but is not equal to n.

Regarding the beneficial effects: in the present disclosure, an amount of a frequency of a spread-spectrum component and charging time corresponding to the frequency of the spread-spectrum component are obtained in advance. By comparing the charging time corresponding to the frequency of the spread-spectrum component with each charging time of a display component, a compensation value for each of the charging time of the display component can be obtained. Therefore, the charging time of the spread-spectrum component and each of the charging time of the display component can be equal, and technical problems of uneven charging between rows and light and dark intervals appearing on products can be eliminated.

DETAILED DESCRIPTION

Embodiments are further described below in detail with reference to accompanying drawings to make objectives, technical solutions, and effects of the present disclosure clearer and more precise. It should be noted that described embodiments are merely used to construct the present disclosure and are not intended to limit the present disclosure.

In conventional display panels, even a minor shift of peak may cause a short burst of a clock signal, leading to an overclocked processor being locked. For example, as size and resolution of thin film transistor liquid crystal displays (TFT-LCDs) become increasingly large, processors thereof are easily overclocked, which causes the spread-spectrum technology to activate. However, a frequency of the spread-spectrum technology and a frequency of a clock signal are different, which leads to uneven charging between rows and generates a lot of light and dark intervals. To solve the above problems, the present disclosure provides a display component compensation method and a display component compensation device.

Figure 1:
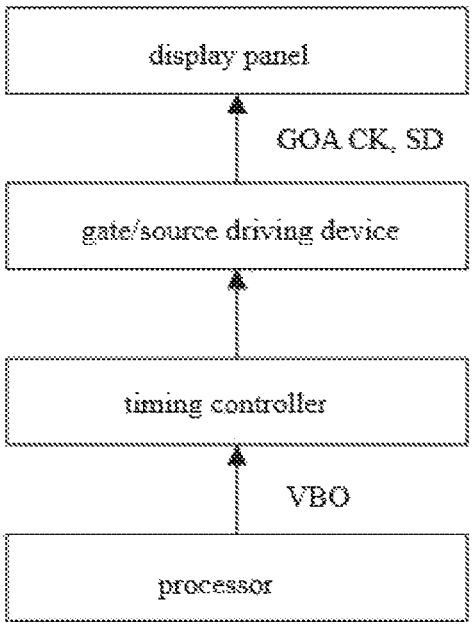
FIG. 1 is a schematic structural view showing a conventional display component.
Figure 2:
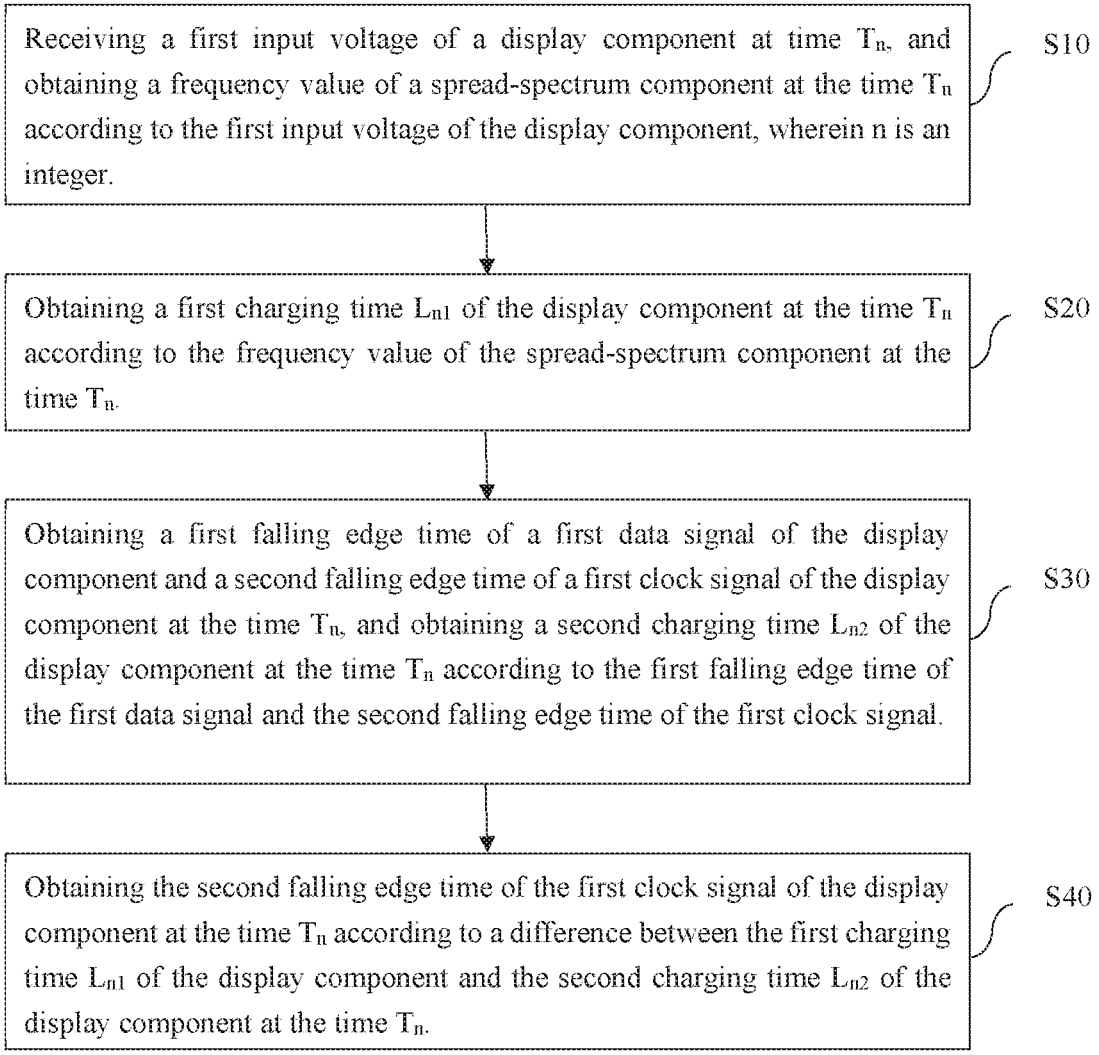
FIG. 2 is a flowchart showing steps of a display component compensation method according to an embodiment of the present disclosure.
Figure 3:
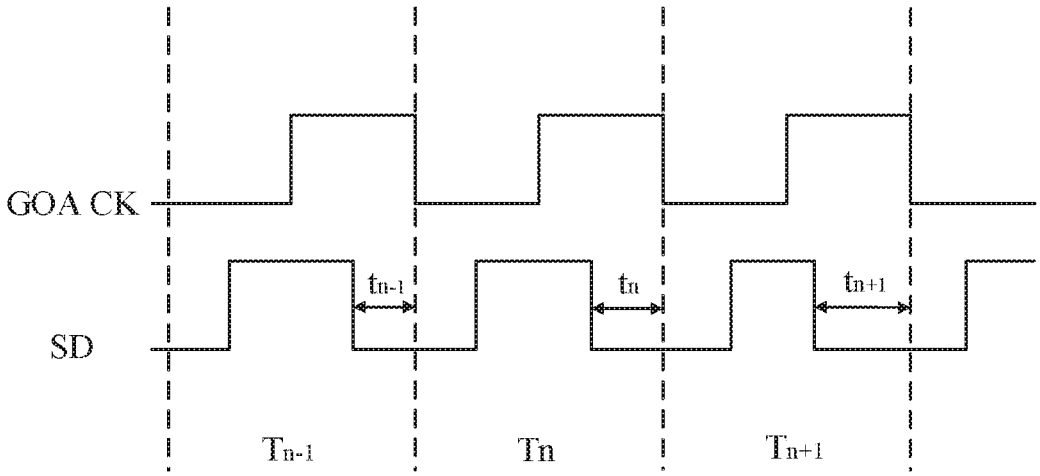
FIG. 3 is a time control diagram showing the display component compensation method according to the embodiment of the present disclosure.

Please refer to FIGS. 1 to 3, the present disclosure provides a display component compensation method, including following steps:

S10: receiving a first input voltage of a display component at time $T_n$, and obtaining a frequency value of a spread-spectrum component at the time $T_n$ according to the first input voltage of the display component, wherein n is an integer.

In the present embodiment, the S10 specifically includes following steps:

S101: receiving a video source signal of the display component at the time $T_n$, and obtaining the first input voltage according to the video source signal of the display component at the time $T_n$.

S102: reading the frequency value of the spread-spectrum component at the time $T_n$ with a predetermined device according to the first input voltage of the display component at the time $T_n$.

In the S101 and the S102, please refer to FIG. 1, a processor of the display component emits the video source signal to a timing controller of the display component, and the timing controller obtains the first input voltage according to the video source signal. In the present embodiment, the first input voltage may be a V-by-One (VBO) voltage which is a digital interface standard technology for image signal transport.

In conventional technologies, a VBO technology can maximally achieve a high-speed transport of 4.0 Gbps. Furthermore, it is widely used in ultra-high definition liquid crystal television fields due to its distinctive encoding that prevents a time delay problem between data and clock of a receiver. Typically, a VBO signal includes a data signal and a time control signal.

In addition, the display component of the present disclosure can directly read a clock (frequency value) of the spread-spectrum component in the display component according to an amount of the first input voltage. Typically, the spread-spectrum component is integrated in a timing controller, and is not described in detail in the present disclosure since it is a conventional technology.

S20: obtaining a first charging time $L_{n1}$ of the display component at the time $T_n$ according to the frequency value of the spread-spectrum component at the time $T_n$.

In the S20, because different first input voltages correspond to different peak frequencies of the processor, an EMI problem due to a peak frequency of pulse may happen when the processor is overclocked. The spread-spectrum component of the present disclosure may reduce the EMI problem caused by a pulse by expanding an endurable frequency range of the display component, thereby preventing the EMI problem caused by an overclocked processor.

Furthermore, the S20 further includes a decision mechanism: when the frequency value of the spread-spectrum component is greater than a peak frequency of a processor, the spread-spectrum component is in a working state, and when the frequency value of the spread-spectrum component is less than or equal to the peak frequency of the processor, the spread-spectrum component is in a non-working state. However, even though the frequency value of the spread-spectrum component is less than or equal to the peak frequency of the processor, changes in frequency of the spread-spectrum component may affect the frequency of the processor to a certain degree, leading to uneven charging time of sub-pixels of the display component in different rows and resulting in light and dark strips appearing on products. Therefore, it is necessary to modify a clock signal of a gate driving device.

In the S20, a first charging time of the display component at time $T_n$ may be directly obtained according to the frequency value of the spread-spectrum component at the time $T_n$. They have a one-to-one correspondence relationship, and can be directly processed in the display component.

S30: obtaining a first falling edge time of a first data signal of the display component and a second falling edge time of a first clock signal of the display component at the time $T_n$, and obtaining a second charging time $L_{n2}$ of the display component at the time $T_n$ according to the first falling edge time of the first data signal and the second falling edge time of the first clock signal.

In the present embodiment, the S30 specifically includes following steps:

S301: obtaining the first falling edge tune of the first data signal of the display component at the time $T_n$.

S302: obtaining the second falling edge time of the first clock signal of the display component at the time $T_n$.

S303: obtaining the second charging time $L_{n2}$ of the display component at the time $T_n$ according to a difference between the first falling edge tune of the first data signal and the second falling edge time of the first clock signal.

In the present embodiment, the S301 specifically includes following steps:

S3011: obtaining a row signal of a plurality of data enable (DE) signals of the display component at the time $T_n$.

S3012: obtaining a rising edge time of the display component at the time $T_n$ and a falling edge time corresponding to the rising edge time at the time $T_n$.

S3013: obtaining the first falling edge time of the first data signal of the display component at the time $T_n$ according to the row signal of the DE signals, the rising edge time of the display component, and the falling edge time corresponding to the rising edge time at the time $T_n$.

In the present embodiment, the plurality of DE signals are emitted from the processor, and include a row signal and a column signal. Only the row signal of the DE signals needs to be recorded.

In the present embodiment, the first data signal is emitted from a source driving device of the display component.

There is a certain relationship between the first data signal and the DE signals. For example, a rising edge time of the DE signals is an output time of the first data signal, and may be a switch of the first data signal. Therefore, in the above steps, the rising edge time of the display component at the time $T_n$ and a falling edge time corresponding to the rising edge time at the time $T_n$ need to be obtained.

In addition, only when the DE signals are at the rising edge time will the first data signal be the DE signals. Therefore, only when the DE signals are at the rising edge time will a falling edge time corresponding to a rising edge time of the first data signal be the first falling edge time of the first data signal which is to be obtained by the above steps.

Please refer to FIG. 3, GOA CK is the first clock signal in the S302, and the first clock signal is a clock signal output from a gate driving circuit in the display component. In FIG. 3, a time interval $t_n$ is the second charging time $L_{n2}$ at the time $T_n$, and is a difference between the first falling edge time of the first data signal and the second falling edge time of the first clock signal.

S40: obtaining the second failing edge time of the first clock signal of the display component at the time $T_n$ according to a difference between the first charging time $L_{n1}$ of the display component and the second charging time $L_{n2}$ of the display component at the time $T_n$.

In the present embodiment, the S40 specifically includes following steps:

S401: obtaining a difference X between the first chanting time $L_{n1}$ of the display component and the second charging time $L_{n2}$ of the display component at the time $T_n$.

S402: adding the difference X and the first falling edge time of the first clock signal at the time $T_n$ together, and obtaining the second falling edge time of the first clock signal of the display component at the time $T_n$.

In the present embodiment, a compensation value (the difference X) of the charging time at the time $T_n$ is obtained according to the first charging time $L_{n1}$ and the second charging time $L_{n2}$ of the display component at the time $T_n$ obtained in the S20 and the S30 after an overclocked component is added.

In the above steps, the compensation value X of the charging time can be represented by an equation: $X=L_{n1}-L_{n2}$. When the compensation value X is positive, the second falling edge time of the first clock signal output by the gate driving circuit at the time $T_n$ needs to be delayed, thereby enlarging the time interval $t_n$, that is, enlarging a charging time of the display component at the time $T_n$. When the compensation value X is negative, the second falling edge time of the first clock signal output by the gate driving circuit at the time $T_n$ needs to be brought forward, thereby enlarging the time intervals $t_n$, that is, reducing the charging time of the display component at the time $T_n$. When the compensation X is 0, the second falling edge time of the first clock signal output by the gate driving circuit at the time $T_n$ does not need to be modified.

In the present embodiment, the display component compensation method further includes following steps:

S50: obtaining a first charging time $L_{m1}$ of the display component at time $T_m$, and making the first charging time $L_{m1}$ of the display component at an $m^{th}$ frame equal to the first charging time $L_{n1}$ of the display component at the time $T_n$, wherein m is an integer, but is not equal to n.

An objective of the S50 is to modify the above steps. As shown in FIG. 3, a technical solution provided by the present embodiment is to make charging time of adjacent time intervals to be equal. In other words, it is to make charging time $t_{n-1}$ at time $T_{n-1}$, charging time $t_n$ at time $T_n$, and charging time $t_{n+1}$ to be equal. However, when there are too many time intervals, the charging time of adjacent time intervals are difficult to be prevented from being different. Therefore, the S50 provides an auxiliary function for the present embodiment. When detecting charging time at a certain period different from charging time at other periods, the charging time at the certain period is modified, thereby ensuring that charging time at all periods are equal.

In the present disclosure, an amount of a frequency of a spread-spectrum component and charging time corresponding to the frequency of the spread-spectrum component are obtained in advance. By comparing the charging time corresponding to the frequency of the spread-spectrum component with each charging time of a display component, a compensation value for each of the charging time of the display component can be obtained. Therefore, the charging time of the spread-spectrum component and the charging time of the display component can be equal, and technical problems of uneven charging between rows and light and dark intervals appearing on products can be eliminated.

Figure 4:
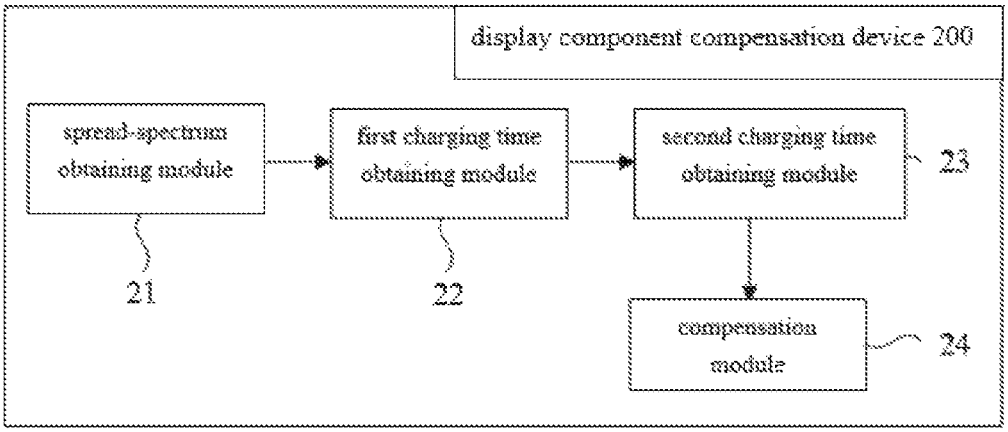
FIG. 4 is a first structural view showing a display component compensation device according to an embodiment of the present disclosure.

Please refer to FIG. 4, the present disclosure further provides a display component compensation device 200, including a spread-spectrum obtaining module 21, a first charging time obtaining module 22, a second charging time obtaining module 23, and a compensation module 24.

The spread-spectrum obtaining module 21 is configured to receive a first input voltage of a display component at time $T_n$, and is configured to obtain a frequency value of a spread-spectrum component at the time $T_n$ according to the first input voltage of the display component, wherein n is an integer.

The first charging time obtaining module 22 is configured to obtain a first charging time $L_{n1}$ of the display component according to the frequency value of the spread-spectrum component at the time $T_n$.

The second charging time obtaining module 23 is configured to obtain a first falling edge time of a first data signal of the display component and a second falling edge time of a first clock signal of the display component at the time $T_n$, and is configured to obtain a second charging time $L_{n2}$ of the display component at the time $T_n$ according to the first falling edge time of the first data signal and the second falling edge time of the first clock signal.

The compensation module 24 is configured to obtain the second falling edge time of the first clock signal of the display component according to a difference between the first charging time $L_{n1}$ and the second charging time $L_{n2}$ of the display component at the time $T_n$.

Figure 5:
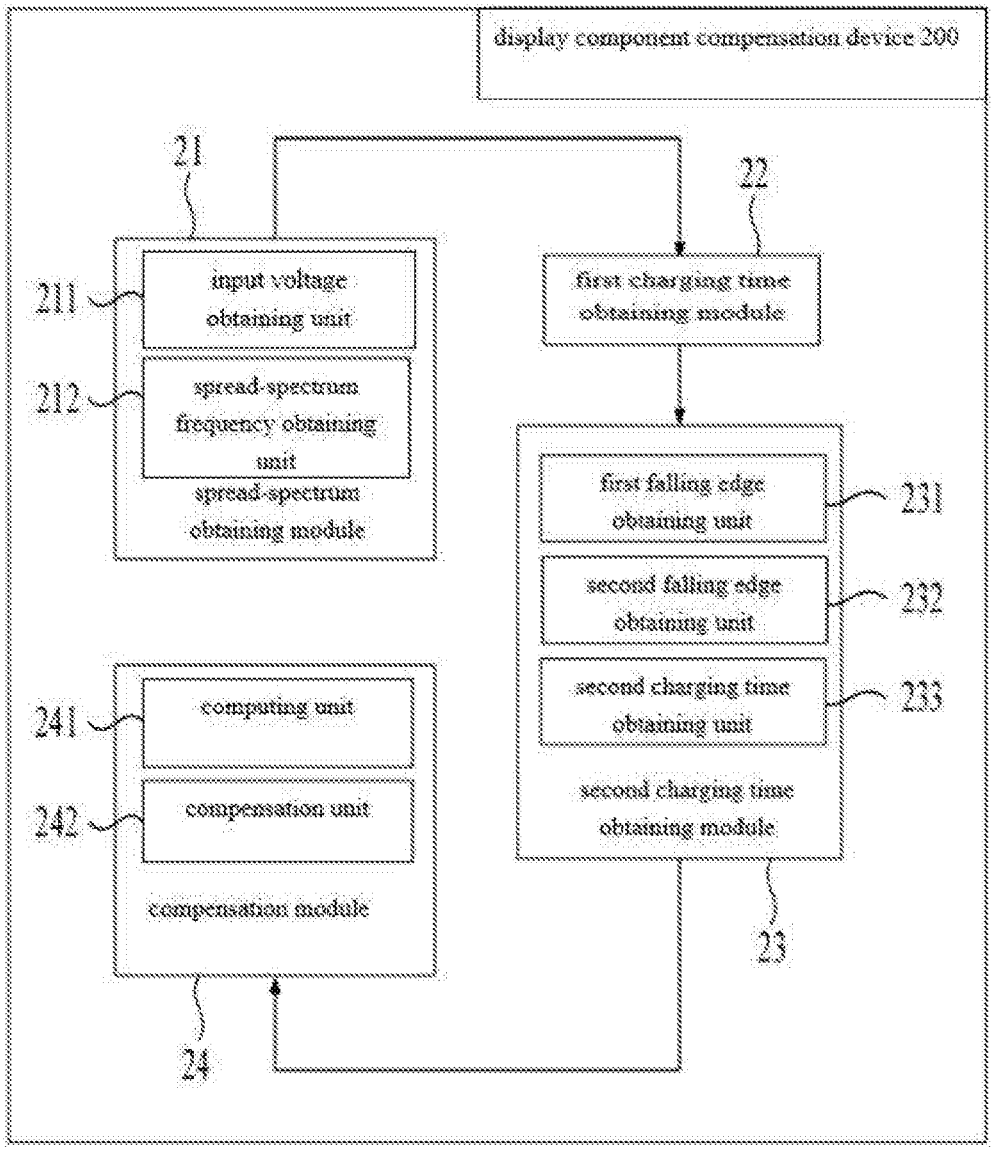
FIG. 5 is a second structural view showing a display component compensation device according to an embodiment of the present disclosure.

Please refer to FIG. 5, the spread-spectrum module 21 includes an input voltage obtaining unit 211 and a spread-spectrum frequency obtaining unit 212.

The input voltage obtaining unit 211 is configured to receive a video source signal of the display component at the time $T_n$, and is configured to obtain the first input voltage according to the video source signal of the display component at the time $T_n$.

The spread-spectrum frequency obtaining unit 212 is configured to read the frequency value of the spread-spectrum component with a predetermined device according to the first input voltage of the display component at the time $T_n$.

The video source signal is emitted from a processor of the display component, and the first input voltage is an image digital signal voltage.

Please refer to FIG. 5, the second charging time obtaining module 23 includes a first falling edge obtaining unit 231, a second falling edge obtaining unit 232, and a second charging time obtaining unit 233.

The first falling edge obtaining time unit 231 is configured to obtain the first falling edge time of the first data signal of the display component at the time $T_n$.

The second falling edge obtaining time unit 232 is configured to obtain the second edge time of the first clock signal of the display component at the time $T_n$.

The second charging tune obtaining unit 233 is configured to obtain the second charging time $L_{n2}$ of the display component at the time $T_n$ according to a difference between the first falling edge time of the first data signal and the second falling edge time of the first clock signal.

Figure 6:
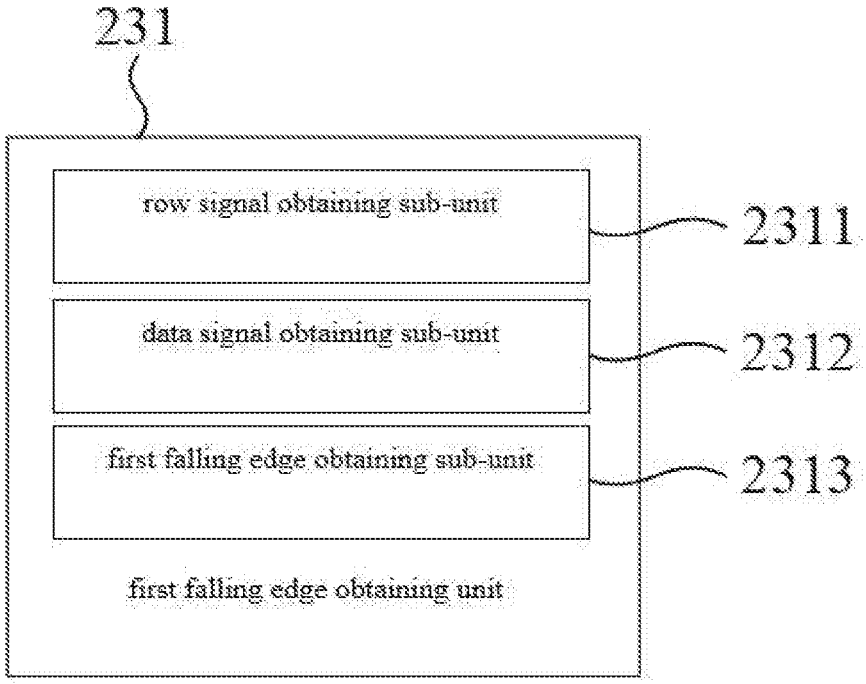
FIG. 6 is a third structural view showing a display component compensation device according to an embodiment of the present disclosure.

Please refer to FIG. 6, the first falling edge obtaining unit 231 includes a row signal obtaining sub-unit 2311, a data signal obtaining sub-unit 2312, and a first falling edge obtaining sub-unit 2313.

The row signal obtaining sub-unit 2311 is configured to obtain a row signal of a plurality of data enable (DE) signals of the display component at the time $T_n$.

The data signal obtaining sub-unit 2312 is configured to obtain a rising edge time of the display component and a falling edge time corresponding to the rising edge time at the time $T_n$.

The first falling edge obtaining sub-unit 2313 is configured to obtain the first falling edge time of the first data signal of the display component at the time $T_n$ according to the row signal of the DE signals, the rising edge time of the display component, and the falling edge time corresponding to the rising edge time at the time $T_n$.

The first data signal is emitted from a source driving device in the display component.

Please refer to FIG. 5, the compensation module 24 includes a computing unit 241 and a compensation unit 242.

The computing unit 241 is configured to obtain a difference X between the first charging time $L_{n1}$ of the display component and the second charging time $L_{n2}$ of the display component at the time $T_n$.

The compensation unit 242 is configured to add the difference X and the first falling edge time of the first clock signal at the time $T_n$ together, and is configured to obtain the second falling edge time of the first clock signal of the display component at the time $T_n$.

Figure 7:
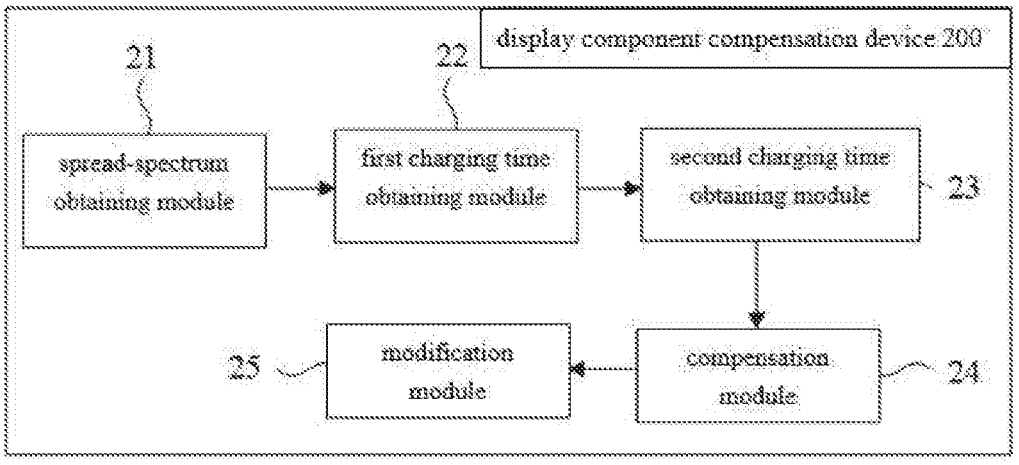
FIG. 7 is a fourth structural view showing a display component compensation device according to an embodiment of the present disclosure.

Please refer to FIG. 7, the display component compensation device 200 further includes a modification module 25.

The modification module 25 is configured to obtain a first charging time $L_{m1}$ of the display component at time $T_m$, and make the first charging time $L_{m1}$ of the display component at an $m^{th}$ frame equal to the first charging time $L_{n1}$ of the display component at the time $T_n$, wherein m is an integer, but is not equal to n.

In the present embodiment, a working principle of the compensation device 400 of the display component can be referred to the above display component compensation method, and is not described here in detail again.

The present disclosure provides a display component compensation method and a display component compensation device. The display component compensation method includes: obtaining a frequency value of a spread-spectrum component at time $T_n$; obtaining a first charge time $T_{n1}$ of the display component at the time $T_n$; obtaining a second charge time $T_{n2}$ of the display component at the time $T_n$; and obtaining a second falling edge time of a first clock signal of the display component at the time $T_n$ according to a difference between the first charging time $T_{n1}$ and the second charging time $T_{n2}$ at the time $T_n$. In the present disclosure, an amount of a frequency of a spread-spectrum component and charging time corresponding to the frequency of the spread-spectrum component are obtained in advance. By comparing the charging time corresponding to the frequency of the spread-spectrum component with each charging time of a display component, a compensation value for each of the charging time of the display component can be obtained. Therefore, the charging time of the spread-spectrum component and the charging time of the display component can be equal, and technical problems of uneven charging between rows and light and dark intervals appearing on products can be eliminated.

In summary, many changes and modifications to the described embodiments can be carried out by those skilled in the art, and all such changes and modifications are intended to be included within the scope of the appended claims.

What is claimed is:

1. A display component compensation method of a display device having a display component, comprising following steps:

receiving a first input voltage of the display component at time $T_n$, and obtaining a frequency value of a spread-spectrum component at the time $T_n$ according to the first input voltage of the display component, wherein n is an integer;

obtaining a first charging time $L_{n1}$ of the display component at the time $T_n$ according to the frequency value of the spread-spectrum component at the time $T_n$;

obtaining a first falling edge time of a first data signal of the display component and a second falling edge time of a first clock signal of the display component at the time $T_n$, and obtaining a second charging time $L_{n2}$ of the display component at the time $T_n$ according to the first falling edge time of the first data signal and the second falling edge time of the first clock signal;

modifying the second falling edge time of the first clock signal of the display component at the time $T_n$ according to a difference between the first charging time $L_{n1}$ of the display component and the second charging time $L_{n2}$ of the display component at the time $T_n$; and applying the modified second falling edge time of the first clock signal to the display device to make the second charging time $L_{n2}$ of the display component equal to the first charging time $L_{n1}$ of the display component;

wherein the first data signal is emitted from a source driving device in the display component.

2. The display component compensation method of the display device having a display component of claim 1, wherein in the step of receiving the first input voltage of the display component at the time $T_n$, and obtaining the frequency value of the spread-spectrum component according to the first input voltage of the display component, the display component compensation method comprises following steps:

receiving a video source signal of the display component at the time $T_n$, and obtaining the first input voltage according to the video source signal of the display component at the time $T_n$; and reading the frequency value of the spread-spectrum component at the time $T_n$ with a predetermined device according to the first input voltage of the display component at the time $T_n$; and wherein the video source signal is emitted from a processor of the display component, and the first input voltage is an image digital signal voltage.

3. The display component compensation method of claim 1 of the display device having a display component, wherein in the step of obtaining the first falling edge time of the first data signal of the display component and the second falling edge time of the first clock signal of the display component at the time $T_n$, and obtaining the second charging time $L_{n2}$ of the display component at the time $T_n$ according to the first falling edge time of the first data signal and the second falling edge time of the first clock signal, the display component compensation method comprises following steps:

obtaining the first falling edge time of the first data signal of the display component at the time $T_n$;

obtaining the second falling edge time of the first clock signal of the display component at the time $T_n$; and obtaining the second charging time $L_{n2}$ of the display component at the time $T_n$ according to a difference between the first falling edge time of the first data signal and the second falling edge time of the first clock signal.

4. The display component compensation method of claim 3 of the display device having a display component, wherein in the step of obtaining the first falling edge time of the first data signal of the display component at the time $T_n$, the display component compensation method comprises following steps:

obtaining a row signal of a plurality of data enable (DE) signals of the display component at the time $T_n$;

obtaining a rising edge time of the display component and a falling edge time corresponding to the rising edge time at the time $T_n$; and obtaining the first falling edge time of the first data signal of the display component at the time $T_n$ according to the row signal of the DE signals, the rising edge time of the display component, and the falling edge time corresponding to the rising edge time at the time $T_n$.

5. The display component compensation method of claim 1 of the display device having a display component, wherein in the step of obtaining the second falling edge time of the first clock signal of the display component at the time $T_n$ according to the difference between the first charging time $L_{n1}$ of the display component and the second charging time $L_{n2}$ of the display component at the time $T_n$, the display component compensation method comprises following steps:

obtaining a difference X between the first charging time $L_{n1}$ of the display component and the second charging time $L_{n2}$ of the display component at the time $T_n$; and adding the difference X and the first falling edge time of the first clock signal at the time $T_n$ together, and obtaining the second falling edge time of the first clock signal of the display component at the time $T_n$.

6. The display component compensation method of claim 1 of the display device having a display component, further comprising following steps:

obtaining a first charging time $L_{m1}$ of the display component at time $T_m$, and making the first charging time $L_{m1}$ of the display component at an $m^{th}$ frame equal to the first charging time $L_{n1}$ of the display component at the time $T_n$, wherein m is an integer, but is not equal to n.

7. The display component compensation method of claim 1 of the display device having a display component, wherein when the frequency value of the spread-spectrum component is greater than a peak frequency of the processor, the spread-spectrum component is in a working state; and when the frequency value of the spread-spectrum component is less than or equal to the peak frequency of the processor, the spread-spectrum component is in a non-working state.

8. A display component compensation method of a display device having a display component, comprising following steps:

receiving a first input voltage of the display component at time $T_n$, and obtaining a frequency value of a spread-spectrum component at the time $T_n$ according to the first input voltage of the display component, wherein n is an integer;

obtaining a first charging time $L_{n1}$ of the display component at the time $T_n$ according to the frequency value of the spread-spectrum component at the time $T_n$;

obtaining a first falling edge time of a first data signal of the display component and a second falling edge time of a first clock signal of the display component at the time $T_n$, and obtaining a second charging time $L_{n2}$ of the display component at the time $T_n$ according to the first falling edge time of the first data signal and the second falling edge time of the first clock signal;

modifying the second falling edge time of the first clock signal of the display component at the time $T_n$ according to a difference between the first charging time $L_{n1}$ of the display component and the second charging time $L_{n2}$ of the display component at the time $T_n$; and applying the modified second falling edge time of the first clock signal to the display device to make the second charging time $L_{n2}$ of the display component equal to the first charging time $L_{n1}$ of the display component.

9. The display component compensation method of the display device having the display component of claim 8, wherein in the step of receiving the first input voltage of the display component at the time $T_n$, and obtaining the frequency value of the spread-spectrum component according to the first input voltage of the display component, the display component compensation method comprises following steps:

receiving a video source signal of the display component at the time $T_n$, and obtaining the first input voltage according to the video source signal of the display component at the time $T_n$; and reading the frequency value of the spread-spectrum component at the time $T_n$ with a predetermined device according to the first input voltage of the display component at the time $T_n$; and wherein the video source signal is emitted from a processor of the display component, and the first input voltage is an image digital signal voltage.

10. The display component compensation method of the display device having the display component of claim 8, wherein in the step of obtaining the first falling edge time of the first data signal of the display component and the second falling edge time of the first clock signal of the display component at the time $T_n$, and obtaining the second charging time $L_{n2}$ of the display component at the time $T_n$ according to the first falling edge time of the first data signal and the second falling edge time of the first clock signal, the display component compensation method comprises following steps:

obtaining the first falling edge time of the first data signal of the display component at the time $T_n$;

obtaining the second falling edge time of the first clock signal of the display component at the time $T_n$; and obtaining the second charging time $L_{n2}$ of the display component at the time $T_n$ according to a difference between the first falling edge time of the first data signal and the second falling edge time of the first clock signal.

11. The display component compensation method of the display device having the display component of claim 10, wherein in the step of obtaining the first falling edge time of the first data signal of the display component at the time $T_n$, the display component compensation method comprises following steps:

obtaining a row signal of a plurality of data enable (DE) signals of the display component at the time $T_n$;

obtaining a rising edge time of the display component and a falling edge time corresponding to the rising edge time at the time $T_n$; and obtaining the first falling edge time of the first data signal of the display component at the time $T_n$ according to the row signal of the DE signals, the rising edge time of the display component, and the falling edge time corresponding to the rising edge time at the time $T_n$.

12. The display component compensation method of the display device having the display component of claim 8, wherein in the step of obtaining the second falling edge time of the first clock signal of the display component at the time $T_n$ according to the difference between the first charging time $L_{n1}$ of the display component and the second charging time $L_{n2}$ of the display component at the time $T_n$, the display component compensation method comprises following steps:

obtaining a difference X between the first charging time $L_{n1}$ of the display component and the second charging time $L_{n2}$ of the display component at the time $T_n$; and adding the difference X and the first falling edge time of the first clock signal at the time $T_n$ together, and obtaining the second falling edge time of the first clock signal of the display component at the time $T_n$.

13. The display component compensation method of the display device having the display component of claim 8, further comprising following steps:

obtaining a first charging time $L_{m1}$ of the display component at time $T_m$, and making the first charging time $L_{m1}$ of the display component at an $m^{th}$ frame equal to the first charging time $L_{n1}$ of the display component at the time $T_n$, wherein m is an integer, but is not equal to n.

14. The display component compensation method of the display device having the display component of claim 8, wherein when the frequency value of the spread-spectrum component is greater than a peak frequency of the processor, the spread-spectrum component is in a working state; and when the frequency value of the spread-spectrum component is less than or equal to the peak frequency of the processor, the spread-spectrum component is in a non-working state.

* * * * *